US009156254B2

(12) United States Patent
Ghozeil et al.

(10) Patent No.: US 9,156,254 B2
(45) Date of Patent: Oct. 13, 2015

(54) FLUID EJECTION DEVICE

(71) Applicant: Hewlett-Packard Development Company, L.P., Houston, TX (US)

(72) Inventors: Adam L Ghozeil, Corvallis, OR (US); Robert N K Browning, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 35 days.

(21) Appl. No.: 14/014,979

(22) Filed: Aug. 30, 2013

(65) Prior Publication Data

US 2015/0062222 A1 Mar. 5, 2015

(51) Int. Cl.
*B41J 2/045* (2006.01)

(52) U.S. Cl.
CPC ..... *B41J 2/0458* (2013.01); *B41J 2/04515* (2013.01); *B41J 2/04541* (2013.01); *B41J 2/04563* (2013.01); *B41J 2/04573* (2013.01); *B41J 2/04588* (2013.01)

(58) Field of Classification Search
CPC ..... B41J 2/30; B41J 2/335–2/33535; B41J 2/35; B41J 2/345; B41J 2/355; B41J 2/3558; B41J 2/375; B41J 2/38; B41J 2/04528; B41J 2/04501; B41J 2/04541; B41J 2/0455; B41J 2/04548; B41J 2/0457; B41J 2/04585; B41J 2/14072; B41J 2/14088; B41J 2/14112; B41J 2/14129; B41J 2/14137
USPC ..... 347/9, 12, 40, 56–62
See application file for complete search history.

(56) References Cited

U.S. PATENT DOCUMENTS

| | | | | |
|---|---|---|---|---|
| 6,302,504 | B1 * | 10/2001 | Imanaka et al. | 347/9 |
| 6,585,343 | B2 | 7/2003 | Bauer | |
| 7,866,798 | B2 | 1/2011 | Sakurai et al. | |
| 2009/0102890 | A1 * | 4/2009 | Rohlfing et al. | 347/57 |

FOREIGN PATENT DOCUMENTS

WO WO-2013019181 2/2013

OTHER PUBLICATIONS

Shibata, S.; Thin-film Thermal Head with Heating Resistors Having Self-controlled Temperature; IEEE; vol. 3; Oct. 8-12, 1995; pp. 1976-1981.

* cited by examiner

*Primary Examiner* — Geoffrey Mruk
*Assistant Examiner* — Scott A Richmond
(74) *Attorney, Agent, or Firm* — Hewlett-Packard Patent Department

(57) ABSTRACT

A fluid ejection device is described. In an example, the fluid ejection device includes a substrate having a chamber formed thereon to contain a fluid. A thin-film stack is formed on the substrate having a resistor formed under the chamber. A transistor is formed in the substrate and coupled to the resistor. A circuit is formed in the substrate coupled to a gate of the transistor to selectively cause the transistor either to supply a firing current to the resistor for ejecting the fluid from the chamber or to dissipate power to warm the device.

10 Claims, 3 Drawing Sheets

400

FLUID EJECTION DEVICE

BACKGROUND

Inkjet technology is widely used for precisely and rapidly dispensing small quantities of fluid. Inkjets eject droplets of fluid out of a nozzle by creating a short pulse of high pressure within a firing chamber. During printing, this ejection process can repeat thousands of times per second. One way to create pressure in the firing chamber is by heating the ink in the firing chamber. A thermal inkjet (TIJ) device include a heating element (e.g., resistor) in the firing chamber. To eject a droplet, an electrical current is passed through the heating element. As the heating element generates heat, a small portion of the fluid within the firing chamber is vaporized. The vapor rapidly expands, forcing a small droplet out of the firing chamber and nozzle. The electrical current is then turned off and the heating element cools. The vapor bubble rapidly collapses, drawing more fluid into the firing chamber.

BRIEF DESCRIPTION OF THE DRAWINGS

Some embodiments of the invention are described with respect to the following figures.

DETAILED DESCRIPTION

Figure 1:
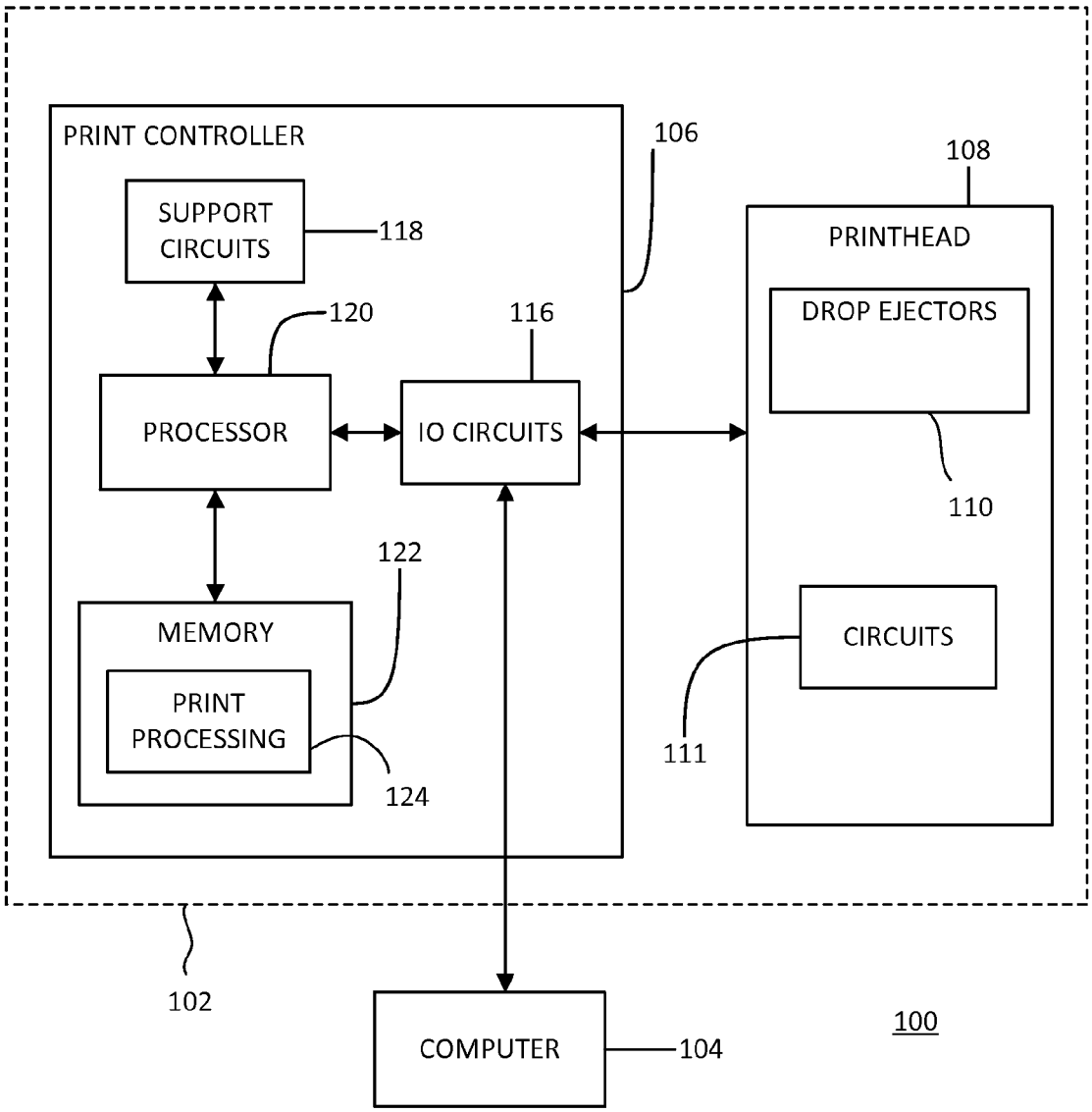
FIG. 1 is a block diagram of an ink jet printer according to an example implementation.

FIG. 1 is a block diagram of an ink jet printer 102 according to an example implementation. The ink jet printer 102 includes a print controller 106 and a printhead 108. The print controller 106 is coupled to the printhead 108. The print controller 106 receives printing data representing an image to be printed to media (media not shown for clarity). The print controller 106 generates firing data for activating drop ejectors on the printhead 108 to eject ink onto the media and produce the image. The print controller 106 provides the firing data to the printhead 108 based on the printing data. As discussed further below, the print controller 106 also provides control signals to the printhead 108 for warming the printhead and ink.

The print controller 106 includes a processor 120, a memory 122, input/output (IO) circuits 116, and various support circuits 118. The processor 120 can include any type of microprocessor known in the art. The support circuits 118 can include cache, power supplies, clock circuits, data registers, and the like. The memory 122 can include random access memory, read only memory, cache memory, magnetic read/write memory, or the like or any combination of such memory devices. The IO circuits 116 can by coupled to the printhead 108. The IO circuits 116 can also be coupled to external devices, such as a computer 104. For example, the IO circuits 116 can receive printing data from an external device (e.g., the computer 104), and provide firing data and/or warming control data to the printhead 108 using the IO circuits 116.

The memory 120 can include instructions executable by the processor 120 for performing a print processing function 124. The print processing function 124 can include machine-readable instructions executable by the processor 120 to perform various functions, including processing printing data and generating firing/warming data for the printhead 108. The print processing function 124 can be stored in any portion of the memory 120, for example, in a non-volatile portion of the memory 120 (e.g., as "firmware" for the printer 120). The print processing function 124 and the memory 120 together comprise a computer-readable medium having machine-readable instructions executable by the processor 120 to perform various functions described below. In another example, the warming function can be controlled by circuitry on the printhead 108 (e.g., the printhead 108 can implement all or a portion of the print processing function, such as the warming function).

The printhead 108 includes a plurality of drop ejectors 110 and associated firing circuits 111. The drop ejectors 110 are in fluidic communication with an ink supply (not shown) for receiving ink. For example, ink can be provided from a container. In an example, the printhead 108 is a thermal ink jet (TIJ) device. The drop ejectors 110 generally include a heating element, a firing chamber, and a nozzle. Ink from the ink supply fills the firing chambers. To eject a droplet, an electrical current generated by the firing circuits 111 is passed through the heater element placed adjacent to the firing chamber. The heating element generated heat, which vaporizes a small portion of the fluid within the firing chamber. The vapor rapidly expands, forcing a small droplet out of the firing chamber and nozzle. The electrical current is then turned off and the resistor cools. The vapor bubble rapidly collapses, drawing more fluid into the firing chamber from the ink supply.

As the performance of TIJ printheads varies as a function of temperature, the print controller 106 controls the operating temperature of the printhead 108 to be within an optimal range. As discussed below, the firing circuits 111 are configured to warm the printhead 108 in response to control signals, which can be provided by the print controller 106. In an example, firing transistors in a high-side switch are used to perform the warming function. This achieves more accurate temperature control than other warming techniques, such as pulse warming (pulsing current through the resistors to achieve a warming function), at a lower cost than use of dedicated warming circuitry (e.g., dedicated trickle warming). As discussed above, in another example, the printhead 108 itself includes circuitry for controlling the operating temperature, rather than the print controller 106.

Figure 2:
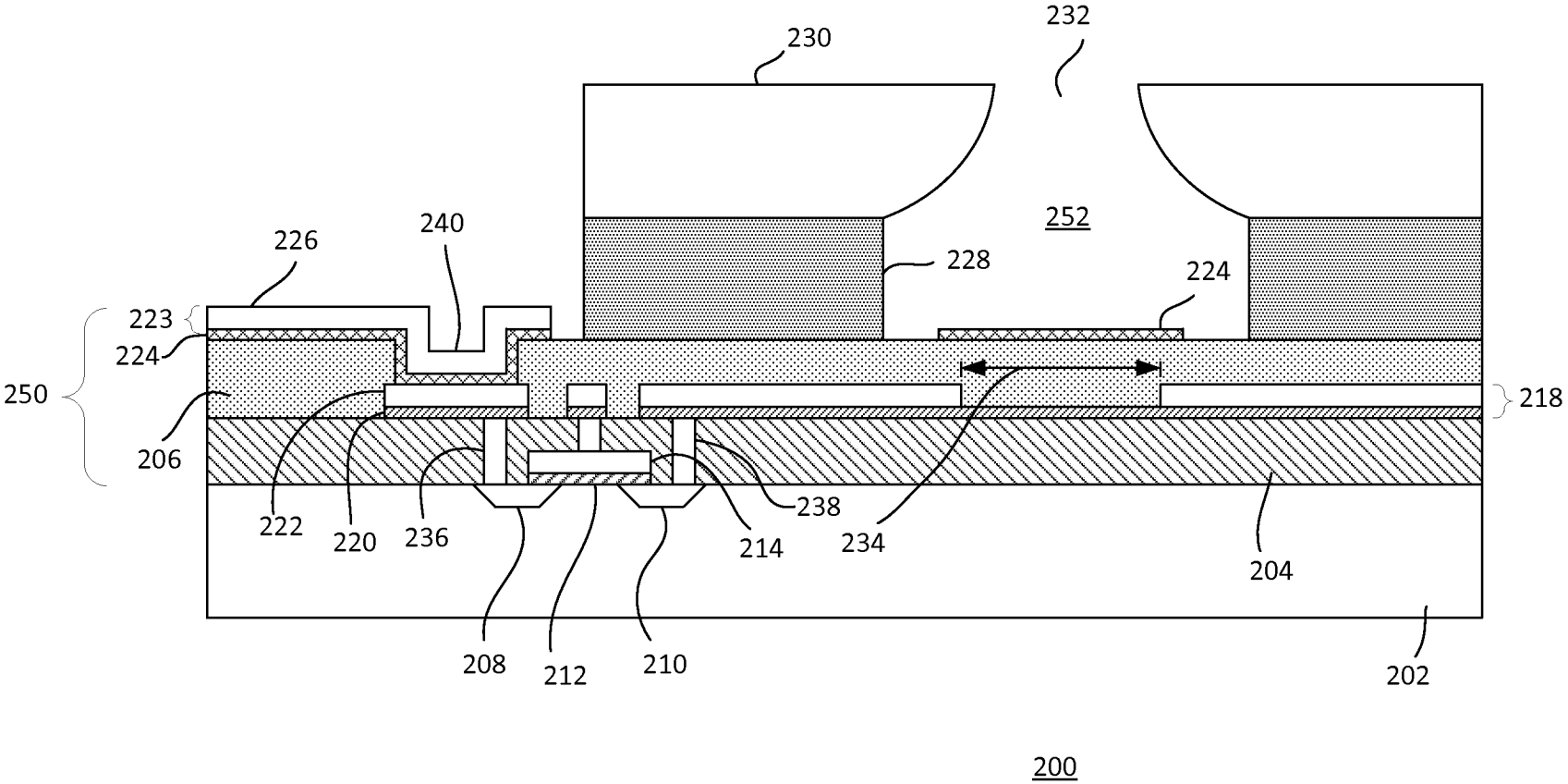
FIG. 2 is a cross-section diagram of a part of a fluid ejection device according to an example implementation.

FIG. 2 is a cross-section diagram of a part of a fluid ejection device 200 according to an example implementation. The fluid ejection device 200 can be used as the printhead 108 in the printer 100 of FIG. 1. The fluid ejection device 200 may be used in a thermal inkjet (TIJ) printhead, for example. The fluid ejection device 200 includes a substrate 202, a thin-film stack 250, and a chamber 252 formed on the thin-film stack 250. The chamber 252 is formed within a barrier layer 228 and a plate layer 230, each deposited on the thin-film stack 250. The chamber 252 is fluidically coupled to a nozzle 232. The chamber 252 is configured to hold fluid (e.g., ink), which can be ejected from the nozzle 232.

The substrate 202 is a semiconductor substrate having doped regions, such as a doped region 208 and a doped region 210. The doped regions 208 and 210 can form source and drain regions of transistor(s). The thin-film stack 250 includes multiple layers deposited on the substrate 202 in a pattern. The layers in the thin-film stack 250 can be deposited and patterned using known semiconductor deposition and processing techniques. It is to be understood that FIG. 2 shows the thin-film stack schematically and omits topology details, such as the varying heights and thicknesses of the layers as they are deposited over the substrate 202.

In an example, the thin-film stack 250 includes a gate-oxide (GOX) layer 212, a polysilicon layer 214, a dielectric layer 204, a metal layer 218, a dielectric layer 206, and a metal layer 223. The GOX layer 212 is a first layer patterned on the substrate 202. The polysilicon layer 214 is patterned on the GOX layer 212. A portion of the polysilicon layer 214 can provide gate(s) for the transistor(s) formed using the doped regions 208 and 210.

The dielectric layer 204 is deposited over the polysilicon layer 214. The dielectric layer 204 can be any type of insulating layer, such as silicon oxide, phosphosilicate glass (PSG), undoped silicate glass (USG), Silicon Carbide (SiC), Silicon Nitride (SiN), tetraethyl orthosilicate (TEOS), or the like, or combinations thereof. Vias (e.g., 236 and 238) can be formed in the dielectric layer 204 to expose portions of the polysilicon layer 214 and the substrate 202.

The metal layer 218 is deposited over the dielectric layer 204 and in the vias formed in the dielectric layer 204. The metal layer 218 can be formed from Tantalum (Ta), Aluminum (Al), Copper (Cu), Gold (AU), or the like or combinations thereof (e.g., TA and AU), including alloys or combinations thereof (e.g., TaAl, AlCu). The metal layer 218 can include multiple conductive layers. For example, conductive layers 220 and 222 are shown. The conductive layers 220 and 222 can have different sheet resistances (sheet resistance is resistance per unit). For example, the conductive layer 220 may have a higher sheet resistance than the conductive layer 222 such that, where the conductive layer 222 is present, the majority of the current goes through the conductive layer 222. Thus, the conductive layer 222 acts as a conducting line and may be used to route signals, and the conductive layer 220 acts as a resistive line, and may be used as a resistor. The metal layer 218 may be formed by first depositing the conductive layer 220, depositing the conductive layer 222, and then etching the conductive layer 222 to expose portions of the conductive layer 220. In particular, a portion 234 of the conductive layer 220 under the chamber 252 is exposed. The exposed portion 234 provides a surface of a resistor under the chamber 252 thermally coupled to the chamber 252.

The dielectric layer 206 is deposited over the metal layer 218. The dielectric layer 206 can be any type of insulating layer, such as silicon oxide, PSG, USG, SiC, SiN, TEOS, or the like or combinations thereof. Portions of the dielectric layer 206 can be etched to expose portions of the metal layer 218 (e.g., vias can be formed in the dielectric layer 206).

The metal layer 223 is deposited over the dielectric layer 206 and in the vias formed in the dielectric layer 206. The metal layer 223 can be formed from Tantalum (Ta), Aluminum (Al), Copper (Cu), Gold (AU), or the like or combinations thereof (e.g., TA and AU), including alloys or combinations thereof (e.g., TaAl, AlCu). The metal layer 223 can include multiple conductive layers, similar to the metal layer 218. For example, the metal layer 223 can include a conductive layer 224 and a conductive layer 226. The conductive layer 226 can be used to provide a bond pad 240 for receiving electrical signals from an external source (not shown). In some examples, the conductive layer 224 can provide an anti-cavitation layer to mitigate mechanical damage to lower layers under the chamber 252 due to collapse of a fluid bubble therein. In other examples, the conductive layer 224 can be omitted from beneath the chamber 252.

A resistor may be heated (fired) by sending a current pulse through it. Any appropriate method can be used to direct a current pulse to the desired resistor, for example, direct addressing, matrix addressing, or a smart drive chip in the fluid ejection device 200. Selection of which resistor to fire may be carried out by a processor in the fluid ejection device 200, a processor in a related controlling device, such as a printer, or a combination thereof (e.g., the print controller 106). Once it has been determined to heat a particular resistor, a pulse of electric current can be delivered to the resistor through circuitry in the fluid ejection device 200.

FIG. 2 shows an example in which a current pulse may be delivered to a resistor formed from the exposed portion 234 of the conductive layer 220 under the chamber 252. The current can be coupled to the bond pad 240, through the metal layer 218, through a transistor formed from the doped regions 208 and 210, and to a portion of the metal layer 218 under the chamber 252 implementing the resistor. Of course, this signal route is merely an example, and variations and other configurations are possible.

It is to be understood that the layers of the thin-film stack 250 are not shown to scale. The layers can have various thicknesses depending on particular device configuration and processes used. In an example, the GOX layer 212 can have a thickness on the order of 750 Angstroms (A); the polysilicon layer 214 on the order of 3600 A; the dielectric layer 204 on the order of 13000 A; the metal layer 218 on the order of 5000 A; the dielectric layer 206 on the order of 3850 A; and the metal layer 223 on the order of 4600 A. Of course, these thicknesses are merely an example and variations and other configurations are possible. Moreover, the particular configuration of layers in the thin-film stack 250 is also provided by way of example. It is to be understood that additional dielectric and/or metal layers can be provided in different configurations. In general, the thin-film stack 250 and substrate 202 provide resistors beneath firing chambers, and circuitry for providing firing signals to the resistors and for providing a warming function, as described below.

Figure 3:
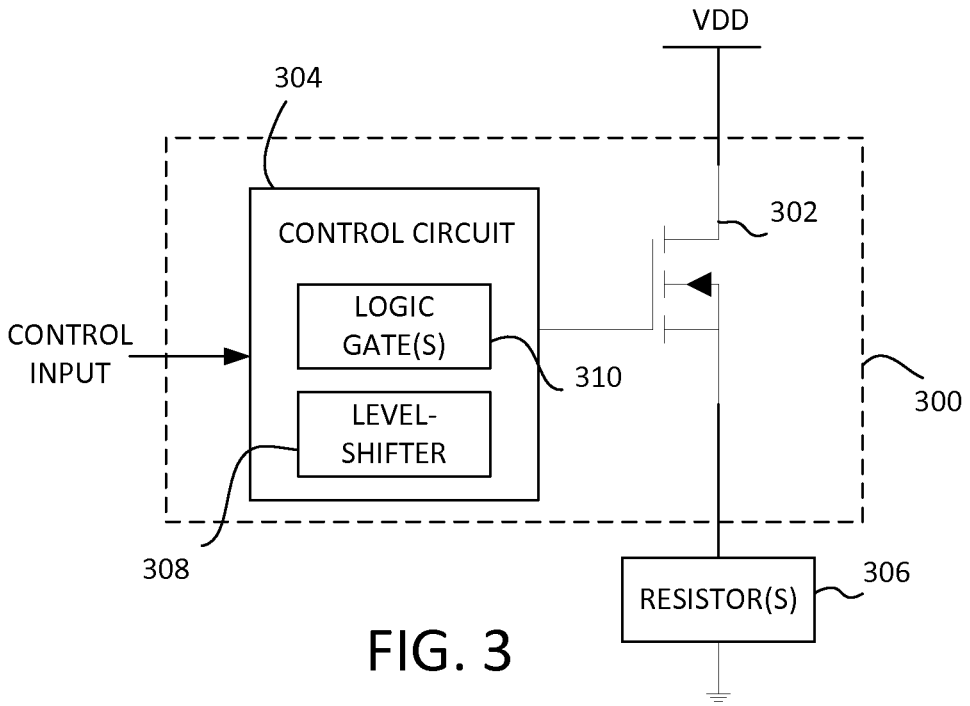
FIG. 3 is a schematic diagram depicting a firing circuit according to an example implementation.

FIG. 3 is a schematic diagram depicting a firing circuit 300 according to an example implementation. The firing circuit 300 can be part of the circuits 111 on the printhead 108 shown in FIG. 1. The circuits 111 can include a plurality of the circuits 300, each coupled to one or more drop ejector resistors. The circuit 300 includes a transistor 302 and a control circuit 304. The transistor 302 is coupled to one or more resistors ("resistor(s) 306") in a high-side switch configuration. In an example, the transistor 302 is an N-channel enhancement field effect transistor (FET) having a source, drain, and gate. The source is coupled to the resistor(s) 306. The drain is coupled to a voltage supply VDD. The gate is coupled to the control circuit 304. The control circuit 304 is responsive to a control input to drive the gate of the transistor 302 between a first voltage and a second voltage. In an example, the control circuit 304 can include one or more logic gates ("logic gate(s) 310") to processing the control input and providing the appropriate voltage to the gate of the transistor 302.

For example, one control input is processed by the logic gate(s) 310 to cause the transistor 302 to supply a firing current to the resistor(s) 306 for ejecting fluid from associated firing chamber(s). In such case, the control circuit 304 provides a voltage to the gate of the transistor 302 such that the transistor 302 is "on" and supplying current to the resistor(s) 306. The applied voltage is typically greater than or equal to VDD. Thus, in some examples, the control circuit 304 includes a level shifter 308 to provide the necessary bias voltage to the transistor 302. It is to be understood that other types of circuits can be used to bias the transistor 302 to "on", such as a charge pump or the like.

Another control input is processed by the logic gate(s) 310 to cause the transistor 302 to dissipate power, which warms the device. In such case, the control circuit 304 provides a voltage to the gate of the transistor 302 such that the transistor dissipates power from the VDD supply. While a small current may be applied to the resistor(s) 306, the current is not enough to cause ink to be ejected. As the transistor 302 dissipates power, the transistor 302 heats the substrate (e.g., the substrate 202 in FIG. 2) and eventually ink in the chamber in a uniform and controllable fashion.

It is to be understood that the circuit 300 is merely an example firing circuit that can be used to either drive firing current to drop ejector(s) or dissipate power to warm the device. A firing circuit can include additional circuitry, such as additional transistors used for various functions (e.g., pull-up, pull-down, biasing, etc). In addition, other types of circuit configurations can be used as a high-side switch, including the use of a P-channel FET transistor in place of the N-channel FET transistor. That is, a P-channel FET transistor can be coupled between the resistor and a reference voltage (e.g., electrical ground). Various high-side switch designs can be employed and used to either driving firing current or dissipate power to warm the device.

In this manner, one or more circuits 300 can be employed to selectively heat given region(s) of the device to maintain device temperature in the optimal range. Using the transistor 302 to warm the device obviates the need for pulse warming using the resistor(s) 306, which can produce temperature fluctuations in the ink that are not accurately captured by temperature sensors on the device. Further, no additional trickle warming circuitry is required, as the warming function is achieved using the same transistors that are used to fire the drop ejectors.

Figure 4:
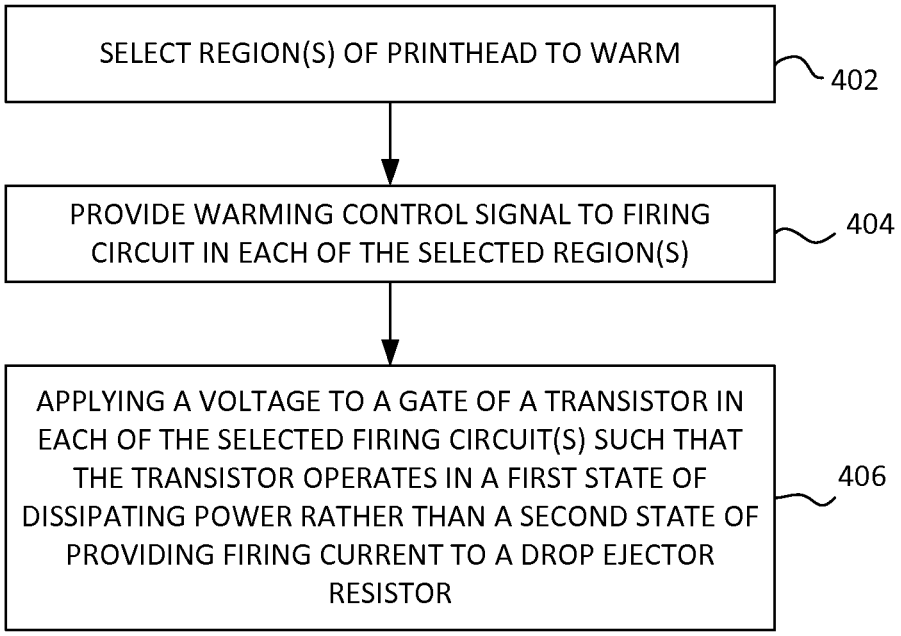
FIG. 4 is a flow diagram depicting a method of warming a printhead according to an example implementation.

FIG. 4 is a flow diagram depicting a method 400 of warming a printhead according to an example implementation. The method 400 may be performed by the printer 100 shown in FIG. 1. The method 400 begins at step 402, where at least one region of the printhead is selected to be warmed. At step 404, a warming control signal is provided to a firing circuit in each of the selected region(s). At step 406, the selected firing circuit(s) each apply a voltage to a gate of a transistor coupled to a drop ejector resistor such that the transistor operates in a first state of dissipating power rather than a second state of providing firing current to the resistor. The method 400 can be repeated to warm various regions of the printhead.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A fluid ejection device, comprising:

a substrate having a chamber formed thereon to contain a fluid;

a thin-film stack formed on the substrate having a resistor formed under the chamber;

a transistor formed in the substrate and coupled to the resistor; and a circuit formed in the substrate coupled to a gate of the transistor to selectively cause the transistor either to supply a firing current to the resistor for ejecting the fluid from the chamber or to dissipate power to warm the device.

2. The fluid ejection device of claim 1, wherein the transistor comprises an N-channel device having a source, a drain, and the gate, the drain being coupled to a voltage supply and the source being coupled to the resistor.

3. The fluid ejection device of claim 1, wherein the circuit comprises at least one logic gate to cause a first voltage to be applied to the gate in response to a first control input and a second voltage to be applied to the gate in response to a second control input.

4. The fluid ejection device of claim 3, further comprising a level-shift circuit formed in the substrate to provide the first voltage to the gate in response to the first control input at the at least one logic gate.

5. The fluid ejection device of claim 1, the circuit is to cause the transistor to dissipate power to warm the device without the firing current being supplied to the resistor by the transistor.

6. A printhead for a printer, comprising:

a plurality of nozzles;

chambers fluidically coupled to the plurality of nozzles;

resistors to eject fluid in the chambers from the plurality of nozzles;

circuits coupled to the resistors, each circuit comprising:

a transistor coupled to at least one of the resistors; and a control circuit coupled to a gate of the transistor to selectively cause the transistor either to supply a firing current to each respective resistor for ejecting the fluid from a respective chamber or to dissipate power to warm the printhead.

7. The printhead claim 6, wherein the transistor in each of the circuits comprises an N-channel device having a source, a drain, and the gate, the drain being coupled to a voltage supply and the source being coupled to each respective resistor.

8. The printhead of claim 7, wherein the control circuit is to cause the transistor to dissipate power to warm the device without the firing current being supplied to the at least one of the resistors by the transistor.

9. The printhead of claim 6, wherein the control circuit in each of the circuits comprises at least one logic gate to cause a first voltage to be applied to the gate in response to a first control input and a second voltage to be applied to the gate in response to a second control input.

10. The printhead of claim 9, wherein each of the circuits further comprises a level-shift circuit to provide the first voltage to the gate in response to the first control input at the at least one logic gate.

* * * * *